United States Patent [19]

Sarda

[11] Patent Number: 4,505,087

[45] Date of Patent: Mar. 19, 1985

[54] METHOD OF CONSTRUCTION OF CONCRETE DECKS WITH HAUNCHED SUPPORTING BEAMS

[75] Inventor: Nandy M. Sarda, Clearwater, Fla.

[73] Assignee: U.S. Filigree Wideslab, Inc., Tampa, Fla.

[21] Appl. No.: 475,185

[22] Filed: Mar. 14, 1983

[51] Int. Cl.[3] ..... E04G 21/00

[52] U.S. Cl. ..... 52/741; 264/31

[58] Field of Search ..... 52/239.9, 741, 283, 52/263, 332, 602, 327, 251, 252; 264/31, 35

[56] References Cited

U.S. PATENT DOCUMENTS

| | | | |
|---|---|---|---|
| 915,421 | 3/1909 | Eisen | 52/252 |
| 1,053,127 | 2/1913 | Golding | 264/31 |
| 1,380,324 | 5/1921 | Piggins | 52/283 |
| 1,516,074 | 11/1924 | Borg | 52/252 |
| 3,918,222 | 11/1975 | Bahramian | 52/263 |
| 4,081,935 | 4/1978 | Wise | 52/236.9 |
| 4,184,423 | 1/1980 | Gutierrez | 52/602 |

FOREIGN PATENT DOCUMENTS

| | | | |
|---|---|---|---|
| 1442994 | 5/1966 | France | 52/327 |
| 115457 | 5/1918 | United Kingdom | 52/283 |

*Primary Examiner*—James L. Ridgill, Jr.

*Attorney, Agent, or Firm*—Duckworth, Allen, Dyer & Pettis

[57] ABSTRACT

A method of construction of concrete decks is described utilizing precast concrete panels to obtain such a deck having supporting beams that are rendered integral therewith and that provide thickened, haunched sections adjacent the supporting columns.

6 Claims, 9 Drawing Figures

FIG. 1
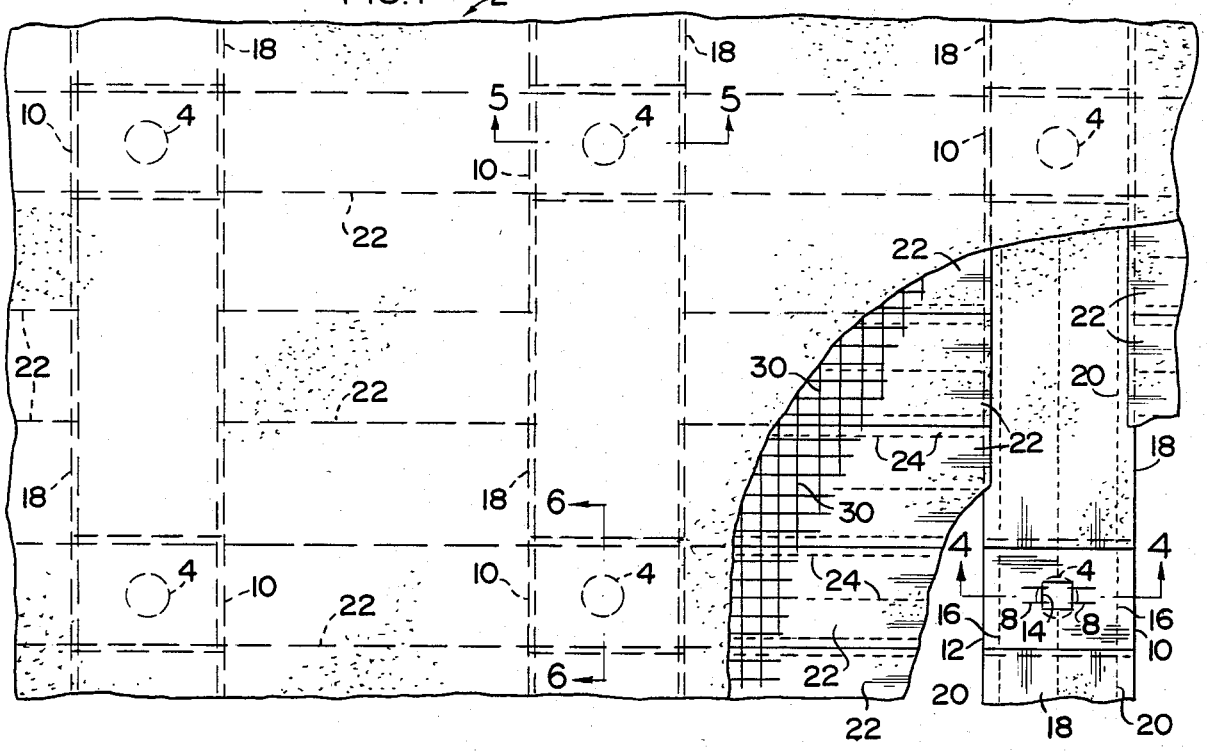
FIG. 2
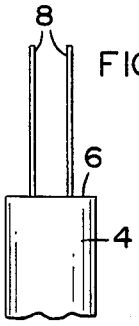
FIG. 3a
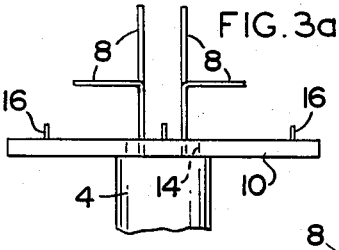
FIG. 4
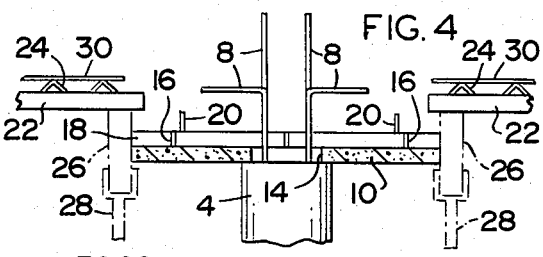
FIG. 3b
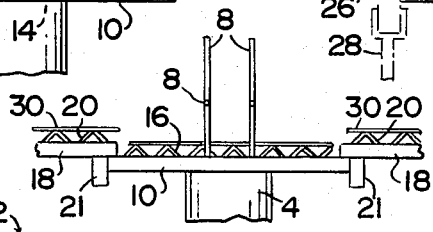
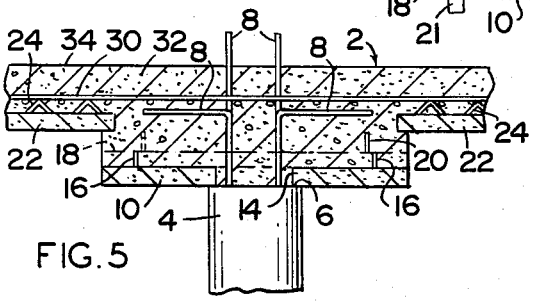
FIG. 5
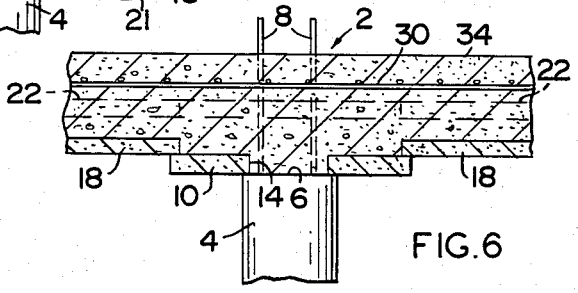
FIG. 6
FIG. 7
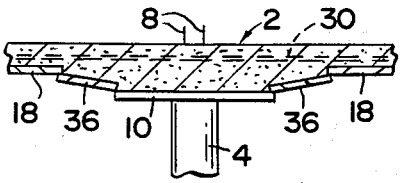
FIG. 8
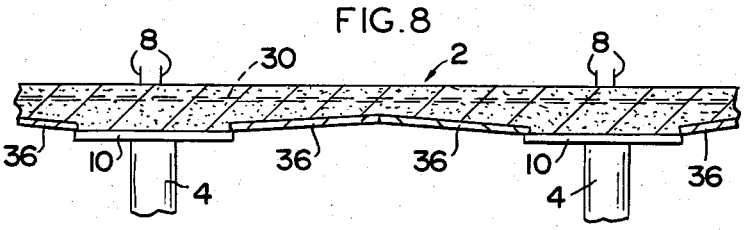

METHOD OF CONSTRUCTION OF CONCRETE DECKS WITH HAUNCHED SUPPORTING BEAMS

BACKGROUND OF THE INVENTION

This invention relates to a method of construction of concrete decks utilizing precast members over which concrete is poured to form a monolithic structure. The invention is directed to a construction procedure providing for lighter weight supporting beams extending between supporting columns.

In known construction techniques utilizing precast members, such as that commonly referred to as the Filigree Wideslab Method, it has been considered preferable to utilize such members having a substantially constant thickness in order to simplify manufacture and transportation of the members. Conventionally, the structure has been formed by the placement of a plurality of beam members, with individual such beams extending between adjacent supporting columns in a row of such columns, with the longitudinal ends of the beams resting or placed adjacent the uppermost end of each respective column. Then, a plurality of precast slabs are placed extending between the respective rows of the beams, with the longitudinal ends of each slab overlapping the edges of the beams. When concrete is then poured over the entire structure, a concrete deck is formed having beams of generally uniform thickness supporting the deck.

While this construction may prove satisfactory in many respects, it suffers several inherent deficiencies. First, because stresses on the beam caused by wind loading and the weight of the deck are greatest adjacent the supporting columns, it is necessary that the beams be thick enough where they join the columns to support those loads. However, toward the center of the span of each beam the strength and thickness required of the beam is considerably less, such that conventional beams are overdesigned and represent both a waste of construction materials and excess weight to be supported by the structure. Additionally, the conventional construction method requires that each beam member be aligned with substantial precision over the uppermost extremity of each of its respective supporting columns.

BRIEF SUMMARY OF THE INVENTION

It is an object of the present invention to provide a novel and improved method of construction of concrete decks utilizing haunched beams to reduce the amount of construction material and weight required to provide adequate strength of the construction. It is a further object of this invention to provide such a construction method that simplifies and expedites construction of such decks utilizing precast concrete panels.

To achieve the foregoing and other object that will become apparent from the detailed disclosure, the present invention provides a method of construction of concrete decks including the steps of constructing a plurality of rows of reinforced concrete columns of predetermined height, placing atop and transverse to the axis of each of these columns a precast concrete capital panel of predetermined thickness and transverse dimensions, supporting and placing between each adjacent pair of the column and capital panel combination in each row elongated precast concrete beam structures with a predetermined portion of the longitudinally outermost extremities of the beam structures horizontally overlapping a portion of the transverse extremities of the respective capital panels, supporting and placing between each adjacent pair of rows of the beam structures a plurality of elongated precast concrete slabs with a predetermined amount of the longitudinally outermost extremities of each slab horizontally overlappinng a portion of the transverse extremities of the beam structures, and pouring concrete over the entire combination of columns, capital panels, beam structures and slabs to a predetermined vertical height so that the entire combination is cast into a monolithic structure with the beam structures and the capital panels forming beams that are haunched adjacent to columns.

In a preferred embodiment of this structure the capital panels are of generally rectangular configuration and include an aperture through the panel to expose at least a portion of the uppermost portion extremity of the column upon which it is placed. Other embodiments provide construction methods for creating beams that taper to thinner cross sections as they extend away from the respective suppporting columns.

BRIEF DESCRIPTION OF THE DRAWINGS

FIG. 1 is a top plan view, partially in section, of a portion of a concrete deck constructed according to the present invention;

FIG. 2 is a fragmentary side elevational view of one of the supporting columns used in the construction of FIG. 1;

FIG. 3 (*a*) is a side elevational view of the column of FIG. 2 with a capital panel positioned atop the column;

FIG. 3(*b*) illustrates the column and capital panel combination of FIG. 3(*a*) with two precast beam panels positioned overlapping opposing edges of the capital panel;

FIG. 4 is an elevational sectional view, at an enlarged scale, taken along line 4—4 of FIG. 1;

FIG. 5 is a side elevational view, partially in section, taken along line 5—5 of FIG. 1;

FIG. 6 is a side elevational view, partially in section, taken along line 6—6 of FIG. 1;

FIG. 7 is a side elevational view of a column and deck combination illustrating an alternative manner of forming the haunched beam structure; and FIG. 8 is a side elevational view, partially in section, of another embodiment of the deck construction of this invention.

DESCRIPTION OF THE PREFERRED EMBODIMENT

As shown in the top plan view of FIG. 1, a concrete deck 2 is supported by a plurality of columns 4 (shown in phantom), which are arranged in a plurality of rows, with each concrete column being of predetermined, and preferably uniform, height. While this preferred embodiment will describe in detail a single layered deck, it is to be understood that the construction techniques readily apply to a multistory construction as well.

The columns 4, as also shown in FIGS. 2 through 8, preferably have a relatively flat uppermost surface 6, from which project reinforcing bars 8, extending generally vertically upwardly for use in subsequent reinforcement of the concrete work.

As shown in FIG. 3(*a*), precast concrete capital panel 10 of predetermined thickness and transverse dimensions is positioned over the uppermost extremity of column 4. A portion of the downward face of this panel 10 is adjacent and faces directly the uppermost extremity of the column 4, and an aperture 14, shown in FIG. 1, extends through the panel 10 to expose a portion of that upper extremity of column 4. As shown in FIG. 3(*a*), certain of the reinforcing members 8 may than be bent for use in connecting to other reinforcing members, in a manner to be described below. Also as shown in FIG. 3(*a*), the capital panel 10 may have cast into it one or more trusses 16 projecting above the upper surface of the panel, the end view of which is shown in FIG. 3(*a*), to provide for additional strength of the panel and also to provide improved bonding of concrete to be poured in a manner to be described below. While not shown in the figures, it is to be understood that the capital panel 10, which preferably is generally rectangular but could be of various other shapes, is supported at this time by appropriate shoring 17, preferably to maintain it in a substantially horizontal position.

FIG. 3(*b*) represents a side elevation of FIG. 3(*a*) taken from a direction orthogonal to that of FIG. 3(*a*) and illustrates yet another step in the construction method of this invention. In the illustration of FIG. 1 is shown the placement between each adjacent pair of the combination of column 4 and capital panel 10 in each row, an elongated precast concrete beam means 18. Such beam means may suitably take the form of a reinforced or prestressed, elongated precast concrete panel within which is cast one or more additional truss structures 20, for the same purpose as the truss 16 of the capital panel 10. As shown in FIGS. 1 and 3(*b*), the beam panels 18 are positioned such that a predetermined portion of the longitudinally outermost extremities of each beam panel 18 horizontally overlap and are vertically proximal to a portion of the transverse extremities of the upper face of their respective capital panels 10. Suitably, the horizontal overlap between the beam panel and the capital panel may be on the order of about two inches. During this construction phase it is again to be understood that the beam panels 18, while positioned adjacent the capital panels, are supported in this position by suitable conventional shoring 21.

FIG. 4 illustrates a subsequent step in this process in which a plurality of elongated precast concrete slabs 22 are positioned and supported between each adjacent pair of rows of beam means. These slabs preferably also contain reinforcing trusses 24, such as are cast into the slabs conventionally produced by the assignee of this application. As shown in FIGS. 1 and 4, these slabs are positioned and supported by shoring 28 with a predetermined amount of the longitudinally outermost extremities of each slab 22 horizontally and vertically proximal to, and preferably overlapping and spaced slightly above, a portion of one of the transverse extremities of the respective beam panels 18. As the beam panels 18 in this preferred embodiment may not fully overlap all portions of the capital panel 10, it may be noted that the slabs 22 that are positioned adjacent such capital panels 10 are postioned such that their longitudinal extremities overlie portions of the mutually opposed edges of the capital panel 10 that are orthogonal to those edges over which the beam panels 18 extend. In this position suitable concrete retaining forms 26 are placed extending upwardly from the transverse extremities of the beam means panels 18 to the underside of the proximal portions of the slabs 22. These forms 26 may be supported by any suitable means, such as supports 28.

Preferably, when the capital panels 10, beam panels 18 and slabs 22 are all in postion, suitably supported by shoring and forming a more or less continuous decking structure, an appropriate configuration of a plurality of reinforcing members 30, commonly known as "rebar", is placed and attached as appropriate over the structure, as shown in the sectional portion of FIG. 1 and in FIG. 5. When the reinforcing members have been suitably placed and appropriate concrete-retaining forms have been placed at the outermost edges of the slabs and beam panels, concrete is poured over the entire combination of columns, capital panels, beam panels and slabs to a predetermined vertical height with the uppermost surface being that indicated by reference designator 34 in FIG. 5. Because the concrete flows through the reinforcing members 30 and onto and around the beam panels 18, slabs 22, capital panels 10, through aperture 14 onto the top of column 4, and intimately surrounds the various trusses 16, 20 and 24, the hardening of this cement effects rendering the entire structure substantially monolithic, with the concrete integrating the slabs and reinforcing members.

A sectional view of the construction of this invention in shown in FIG. 6, taken in a direction orthogonal to the view of FIG. 5. These views clearly indicate the manner in which this construction provides for a haunched or thickened supporting beam structure where the beam structure joins with the supporting column 4. This construction provides substantial benefit in that the increased thickness provides increased strength for the deck structure where it is supported by the columns. As is well known, the greatest stresses experienced and thus the greatest strength required for such supporting beam structure is adjacent the supporting columns. In conventional prior art techniques for construction of concrete decks utilizing precast slabs, the beam structures have been substantially uniform in thickness throughout. This has required that such uniform thickness of the beams be at least sufficient to withstand the increased stresses adjacent the supporting columns. Accordingly, such conventional construction techniques have results in beam structures that, if strong enough adjacent the supporting columns, are excessively thick and heavy in the portions spaced from those supporting columns. The "haunched beam" construction technique that is the subject of this invention overcomes this disadvantage by providing the necessary increased strength and thickness adjacent the supporting columns but using substantially thinner, but fully adequate, beam sections in the portions spaced from the columns. The above-described construction procedure results in the beams, as well as the deck, being cast into generally monolithic integral units having the necessary integrity and strength.

In the design of such haunched beam configuration, conventional iterative calculation techniques are used, either manually or with the assistance of data processing. Initially, from generally known material and design properties and performance requirements a maximum deflection and moment of such a supporting beam structure is calculated for a beam structure that is uniform and not haunched. Then, moments of inertia relating to the thinner sections of the haunched beams are utilized again to calculate maximum deflection, with iteration being continued until the maximum deflection of the haunched beam structure is equal to or less than that of the beam structure of continuous thickness. Then, any necessary additional computation for potential microcracking of the concrete construction is utilized, thus providing the necessary information for the computation of beam and deck thickness. These computational techniques are generally conventional, although they may be performed by various electronic data processing techniques.

In FIGS. 7 and 8 are illustrated alternative cross-sectional configurations of decks constructed according to the principles of this invention but in which the outer extremities of the beam structures, adjacent to the portion where they join the capital panel 10, extend angularly upwardly from those capital panels to join the remainder of the beam structure. In FIG. 7 a beam outer extremity precast panel 36 extends angularly upwardly from the capital panel 10 to the substantially horizontally positioned beam panel 18. This configuration of FIG. 7 provides for a more gradual transition from the thickest portion of the haunched section of the beam adjacent the column to a substantially thinner center section formed over beam panel 18.

FIG. 8 carries the angularly upwardly extending beam panel 36 further, thus eliminating the horizontally extending beam panel 18 altogether. The portions of the respective beam panels 36 remote from the capital panels 10 thus continue their angularly upward extent until adjacent such panels 36 join one another, as illustrated.

As illustrated in all of the FIGS. 2 through 8, where the deck to be formed may be only a lower or intermediate deck of a multistory structure, it is preferable that a portion of the reinforcing members 8 from the supporting column 4 project upwardly from the completed deck 2 to provide reinforcing members to anchor the forms for construction of the next vertical extension of column 4 upwardly from that deck 2.

While the foreging describes several particularly preferred embodiments of the present invention, these embodiments are to be considered illustrative only of the principles of this invention and not limitative thereof. Because numerous variations and modifications are within the scope of the invention and will readily occur to those skilled in the art, the scope of the invention is to be determined solely by the claims appended hereto.

What is claimed is:

1. A method of construction of concrete decks with haunched supporting beams and formed of precast concrete members supported upon reinforced concrete columns with concrete poured thereover, comprising the steps of constructing a plurality of rows of reinforced concrete columns of predetermined height;

supporting by shoring a precast concrete capital panel positioned above and transverse to the axis of each of said columns, said panel having predetermined thickness and transverse dimensions with a portion of the downward face of said panel being adjacent and facing the uppermost extremity of said column, and said panel having an aperture therethrough exposing at least a portion of said column uppermost extremity;

supporting by shoring and placing between each adjacent pair of said column and capital panel combinations in each row elongated precast concrete beam means, with a predetermined portion of the longitudinally outermost extremities of said beam means horizontally overlapping with a downwardly facing portion thereof vertically proximal to a portion of the transverse extremities of the upper face of the respective said capital panels;

supporting by shoring and placing between each adjacent pair of rows of said beam means a plurality of elongated precast concrete slabs with a predetermined amount of the longitudinally outermost extremities of each said slab horizontally and vertically proximal to but supported above a portion of one of the transverse extremities of the respective said beam means; and pouring concrete over the entire combination of columns, capital panels, beam means and slabs to a predetermined vertical height, whereby the entire combination is cast into a monolithic structure with the beam means and the capital panels forming beams haunched adjacent the columns.

2. The method of claim 1 wherein said placing of said beam means comprises positioning and supporting said beam means with the outer extremity portion thereof extending angularly upwardly from said capital panel to a point where it joins a portion of the remainder of said beam means.

3. The method of claim 1 further comprising the steps of placing concrete retaining forms extending upwardly from said transverse extremities of said capital panels to the underside of said proximal portions of said beam means and from said transverse extremities of said beam means to the underside of said proximal portions of said slabs; and placing a plurality of reinforcing members extending over the upwardly facing portions of said beam means and said capital panels such that the concrete poured over said combination will be poured over said reinforcing members.

4. The method of claim 1 wherein said faces of said capital panels are of generally rectangular configuration and wherein said step of placing said beam means comprises positioning said beam means with one of the longitudinal extremities of at least one of said beam means in an overlying relationship with portions of at least one of a first pair of mutually opposed edges of the respective said capital panels.

5. The method of claim 4 wherein said step of placing said beam means comprises positioning one of said beam means with one of the longitudinal extremities thereof in an overlying relationship with a portion of one of said first pair of mutually opposed edges of one said capital panel, and positioning one of the longitudinal extremities of another said beam means in an overlying relationship with a portion of the other of said first pair of mutually opposed edges of said capital panel.

6. The method of either of claims 4 or 5 wherein the step of placing said precast concrete slabs comprises positioning a portion of one of the longitudinal extremities of at least one said slab in an overlying relationship with a portion of one of a second pair of mutually opposed edges of said capital panel.

* * * * *